US010293511B2

(12) United States Patent
Peterson

(10) Patent No.: US 10,293,511 B2
(45) Date of Patent: May 21, 2019

(54) SAWMILL

(71) Applicant: Karl Jacob Peterson, Tauranga (NZ)

(72) Inventor: Karl Jacob Peterson, Tauranga (NZ)

( * ) Notice: Subject to any disclaimer, the term of this patent is extended or adjusted under 35 U.S.C. 154(b) by 257 days.

(21) Appl. No.: 14/881,770

(22) Filed: Oct. 13, 2015

(65) Prior Publication Data

US 2016/0214270 A1 Jul. 28, 2016

(30) Foreign Application Priority Data

Sep. 15, 2014 (NZ) ..... 700006

(51) Int. Cl.
*B27B 5/20* (2006.01)
*B27B 5/36* (2006.01)
*B27B 7/00* (2006.01)

(52) U.S. Cl.
CPC ..... *B27B 5/207* (2013.01); *B27B 5/36* (2013.01); *B27B 7/00* (2013.01)

(58) Field of Classification Search
CPC .. B27B 5/207; B27B 7/00; B27B 5/36; B27B 31/04; B27B 1/00; B27B 7/02; B27B 5/10; B23D 45/027; Y10T 83/037; Y10T 83/7693; Y10T 83/8821; Y10T 83/8769; Y10T 83/667; Y10T 83/7697; Y10T 83/778; Y10T 83/7772
USPC ..... 83/485, 471.2, 884, 411.7, 471.1, 471.3, 83/703, 873, 613, 486.1, 488, 743, 578, 83/574, 745; 144/378, 377
See application file for complete search history.

(56) References Cited

U.S. PATENT DOCUMENTS 2,506,076 A * 5/1950 Garrison ..... B23D 45/024 125/14
4,584,918 A * 4/1986 Stubbe ..... B27B 5/207 83/471.3
5,109,899 A * 5/1992 Henderickson ..... B23D 45/027 144/378
7,530,298 B2 * 5/2009 Peterson ..... B27B 5/207 144/378
2014/0230625 A1 * 8/2014 Peterson ..... B23D 45/027 83/613

* cited by examiner

*Primary Examiner* — Ghassem Alie
(74) *Attorney, Agent, or Firm* — Collard & Roe, P.C.

(57) ABSTRACT

A sawmill 1 has an operator end 6, a pair of end frames 2, a track 3 elevated by and extending from at least one end frame to the other, a carriage moveable 4 to carry a saw 5 along at least part of the track, flip elements able to move the saw from a horizontal cutting orientation to a vertical cutting orientation, and a relocatable stopper 13 associated with the track. The carriage 4 can be driven away from the operator end 16 with the saw 5 in the horizontal cutting orientation to contact the stopper 13 when the carriage, this resulting in the flip elements automatically moving the saw 4 into the vertical cutting orientation.

13 Claims, 2 Drawing Sheets

SAWMILL

FIELD OF INVENTION

Figure 1:
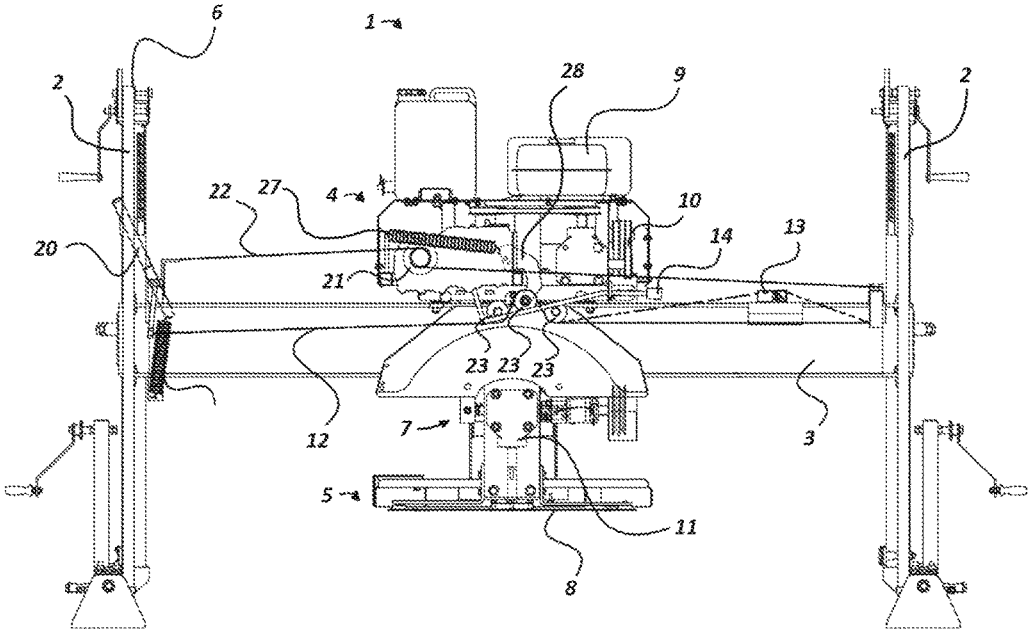

This invention relates to a sawmill. A particularly preferred embodiment relates to a portable sawmill with a swing blade saw.

BACKGROUND

It is known to assemble portable sawmills for milling logs. This may involve a frame structure supporting a saw carriage above a log. The saw carriage moves back and forth along a horizontal beam elevated between end frames, to bring a circular saw blade into contact with the log. On one pass along the log the blade makes a vertical cut, is flipped through 90°, and is then run back along the log to make an intersecting horizontal cut. By repeating the process, flipping the blade between horizontal and vertical for each pass, and periodically adjusting the height of the carriage, the log can be reduced into a series of planks.

It is an object of a preferred embodiment of the invention to provide a sawmill which can be used to mill a log in the manner described above. While this object applies to the preferred embodiment, it should be appreciated that this does not define the object of the invention per se. In its broadest sense the object of the invention is simply to provide the public with a useful choice.

The term "comprises", or derivatives thereof, when used in connection with a number of features should not be taken to exclude the optional presence of features over and above those specifically listed. The term should therefore to be construed in a nonlimiting manner.

SUMMARY OF THE INVENTION

According to one aspect of the invention there is provided a sawmill having:

- an operator end;
- a pair of end frames;
- a track elevated by and extending from at least one end frame to the other;
- a carriage moveable to carry a saw along at least part of the track;
- flip means able to move the saw from a horizontal cutting orientation to a vertical cutting orientation; and
- a relocatable stopper associated with the track;

the sawmill formed such that the carriage is able to be driven away from the operator end with the saw in the horizontal cutting orientation to contact the stopper when the carriage is at a predetermined position along the track, such contact resulting in the flip means automatically moving the saw into the vertical cutting orientation for making a vertical cut back towards the operator end, the saw being such that when at the operator end it can be manually flipped back to the horizontal cutting orientation.

Optionally the flip means comprises a gas strut. Optionally each end frame is generally in the shape of an inverted "T". Optionally there is only one track. Optionally there is a controller at the operator end for activating movement of the saw carriage away from and subsequently back towards the operator end. Optionally the flip means comprises a swing arm which releasably bears against a locking head (eg a conical head) to lock the saw in the horizontal cutting orientation.

Optionally the flip means comprises a swing arm which releasably bears against a locking head (eg a conical head) to lock the saw in the vertical cutting orientation.

Optionally the carriage has a rotating drum which engages a fixed cord or chain such that rotation of the drum causes the carriage the move along the cord or chain away from or towards the operator end depending on the direction that the drum rotates.

Optionally the drum can be activated to turn clockwise or anticlockwise by pulling on a control cord from the operator end.

Optionally the control cord extends around a pivoting roller at the carriage and causes the roller to pivot up or down depending on how much tension the control cord is under, such pivoting movement of the roller causing movement of a lever connected to the pivoting roller to regulate the direction of movement of the carriage.

Optionally the control cord extends under fixed rollers situated either side of the pivoting roller.

Optionally the flip means comprises a counterweight. Optionally the flip means comprises a hydraulic strut.

Optionally the sawmill is such that manual movement of the saw from the vertical to horizontal energises the flip means (eg a gas strut, hydraulic strut or counterweight arrangement) with sufficient energy to cause flipping of the saw from the horizontal to vertical orientation when the relocatable stopper is contacted by the carriage.

DRAWINGS

Figure 2:
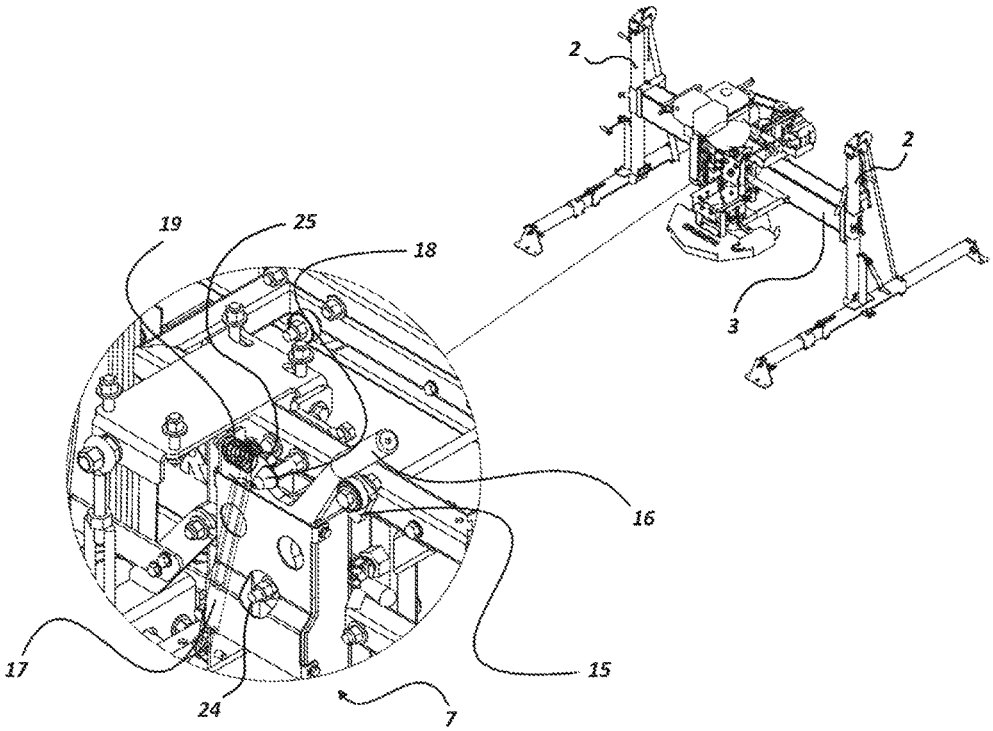
Figure 3:
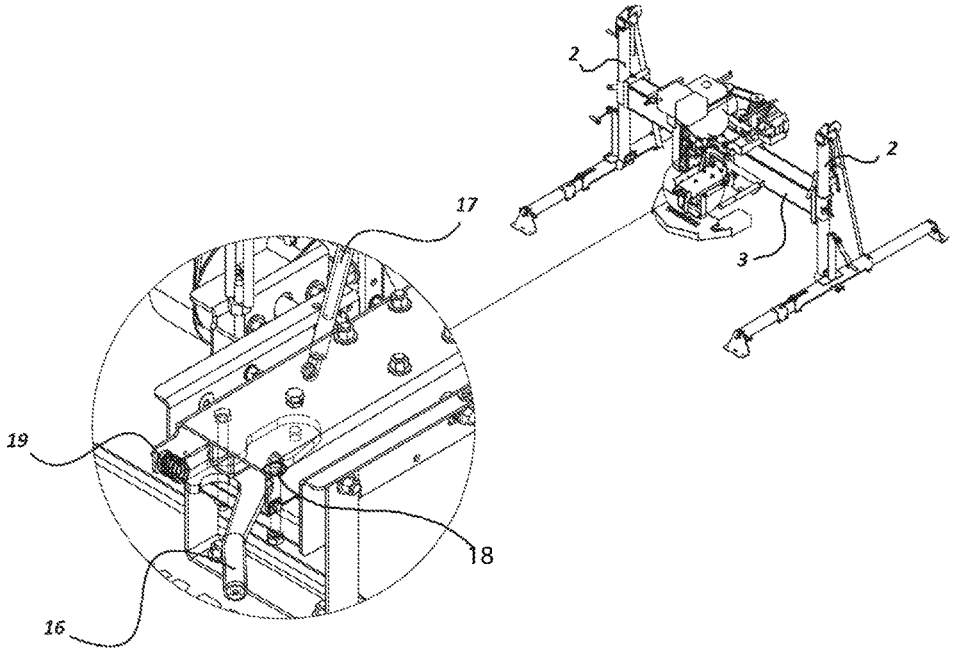

Some preferred forms of the invention will now be described by way of example and with reference to the accompanying drawings, of which:

FIG. 1 is a side elevation view of a portable sawmill;

FIG. 2 provides isometric view detail of a blade flip mechanism when orienting a blade in a horizontal cutting orientation; and FIG. 3 provides isometric view detail of the blade flip mechanism when orienting a blade in a vertical cutting orientation.

DETAILED DESCRIPTION

As shown in the drawings a sawmill 1 has a pair of inverted T-shaped end frames 2 supporting an elevated horizontal track 3. A saw carriage 4 can move along the track to carry a circular saw 5 away from an operator end 6 of the sawmill, and then back. The sawmill has a blade flip mechanism 7 which enables the saw's blade 8 to be set in a horizontal cutting orientation, and then a vertical cutting orientation.

Starting at the operator end 6 with the blade 8 in a horizontal orientation, the carriage 4 is driven along the track 3 so that the blade makes a horizontal cut in an underlying log (not shown). When the blade has passed out the far end of the log the flip mechanism 7 causes the blade to move through a 90° turn to assume a vertical cutting orientation. The carriage is then driven back towards the operator end 6 to make a vertical cut in the log, intersecting the horizontal cut. When the blade has passed back through the log, a workman manually causes the blade 8 to revert to a horizontal cutting orientation.

The saw is adjusted sideways and the blade is again driven through the log, ie heading away from the operator end. By making repeated intersecting horizontal and vertical sweeps through the log in this manner, a row of planks is eventually milled. At that point the track 3 is adjustably lowered to enable a new row of planks to be milled in the same way.

It is preferable that the blade 8 is always in the horizontal cutting orientation as it moves away from the operator end 6. This is because the weight of a plank or slab being cut may bear against the horizontal blade under gravity, thereby increasing the risk of the plank or slab being thrown forward.

FIG. 1 illustrates detail of the sawmill showing the saw's engine 9 for driving the blade 8 via a series of belts 10 and a 90° gearbox 11. When the saw is at the operator end 6, the workman is able to manually swing the blade 8 from the vertical to horizontal cutting orientation. The workman them pulls a lever 20 to move a control rope 12 to actuate a mechanical feed which drives the carriage 4, and therefore the saw 5, towards the other end of the sawmill, away from the operator end 6.

When the carriage 4 gets to a predetermined distance away from the operator end, eg with the blade having passed out the far end of a log, the carriage 4 strikes or bumps against a relocatable stopper 13 positioned on the track 3. This contact activates the flip mechanism 7 to automatically swing the blade 8 to a vertical cutting orientation.

More specifically, and with reference to FIG. 1, a carriage trigger 14 bumps into the stopper 13. Referring to FIG. 2, the trigger 14 is linked to a cam roller 15 which releases a swing arm 16 to cause the saw 5 to flip. More specifically, the swing arm 16 pivots about a bolt 24. When the saw 5 is horizontal, ie in the FIG. 2 position, a thumb 25 of the swing arm 16 is locked against the inside of a locking cone or locking head 18. However movement of the arm 16 forwards causes the thumb 25 to release from the behind the cone or locking head 18, thereby freeing a gas strut 17 to extend outwards to flip the blade 8 beneath it (not shown) to a vertical orientation corresponding to FIG. 3. The blade 8 is locked in this position for making a vertical cut back towards the operator end 6. Referring again to FIG. 3, locking of the blade in its vertical orientation is achieved by a part of the swing arm 16 lodging under a vertical locking cone 18. The swing arm 16 can of course be pulled free subsequently, to move the saw 5 and its blade 8 to the horizontal orientation. As shown in FIG. 2, a spring mechanism 19 serves to keep pressure between the thumb 25 and the cone or locking head 18 to avoid undesirable rattling.

Referring to FIG. 1, the rope 12 is pulled by the lever 20 to cause the carriage 4 to be driven back from the far end. The lever 20 is spring loaded to cause it to naturally return to a neutral position. Pulling the lever 20 one way causes the carriage 4 to move away from the operator end 6, and pulling it the other way causes the carriage 4 to move towards the operator end. In each case the carriage 4 can be driven at variable speed.

In some embodiments of the invention the carriage 4 may be disconnected from its drive mechanism and moved along the track 3 manually. The saw 4 may also be mechanically disengaged and then flipped between horizontal and vertical manually at the far end, although preferably travel of the carriage and flipping of the saw at the far end are mechanically powered.

Referring to FIG. 1, in preferred embodiments of the invention the carriage 4 is driven by a hydrostatic transmission, powered by the saw's engine 9. The transmission has a rotating shaft connected to a drum 21. Preferably there is a driving rope 22 wrapped several times around the drum 21. As the drum 21 turns, it runs along the rope under friction to cause the carriage 4 to move from one end of the sawmill to the other, depending on the direction of rotation of the drum 21. While use of the rope 22 is preferable, in other embodiments adjustments may be made so use chain or wire, etc.

As also shown in FIG. 1, the control rope 12 threads around a trio of rollers 23 on the carriage 4 to help keep it under tension. The middle of these rollers 23 is pivotably moveable up and down and the rollers either side of it are fixed. A spring 27 tensions a lever 28 connected to the centre one of the rollers 23. Pulling on the lever 20 causes the tension on the rope 12 to change. Greater tension causes the central roller 23 to swing slightly down, and less tension causes the central roller to swing slightly up. This causes the lever 28 to pull on the spring 27 to a greater or lesser degree, which in turns regulates the direction of rotation of the drum 21, and thus the direction of movement of the carriage 4.

Preferably the workman causes the blade 8 to flip from its vertical orientation back to its horizontal orientation each time the carriage has returned to the operator end. This is achieved by the workman grasping the swing arm 16 and moving it from its FIG. 3 to the FIG. 2 disposition. The workman provides the manual force needed for this, which at the same time energises the gas strut 17 so that when it is at the opposite end of the sawmill the gas strut 17 has sufficient energy to cause the blade to move to its vertical cutting orientation. In other words, the energy expended by the workman when flipping the blade from vertical to horizontal compresses or 'primes' the gas strut 17 for later release.

In alternative embodiments of the invention the gas strut 17 may be replaced by a 10 generally similar hydraulic strut, a counterweight mechanism or some other arrangement sufficient to cause the blade 8 to mechanically flip to vertical when at the remote end of the sawmill.

Referring to FIG. 1, in some embodiments of the invention the control rope 12 may engage the stopper 13 at an upward angle. This increases tension on the rope and as the carriage nears the stopper 13 and results in the carriage slowing down in anticipation of impending contact with the stopper.

It will be appreciated that the sawmill is such that a workman can operate it completely from the operator end, pulling on the lever 20 one way or the other to control the direction of movement of the carriage 4. By appropriately positioning the stopper 13 on the track 3 the saw 5 flips from a horizontal to vertical cutting orientation automatically when through a log at the far end, and the workman manually flips the saw 5 back to a horizontal orientation when it arrives back at the operator end. Flipping the saw 5 to the horizontal orientation serves to energise the gas strut 17 (or hydraulic strut or counterweight as the case may be) so there is sufficient energy to flip the saw 4 to vertical at the far end.

While some preferred forms of the invention have been described by way of example it 30 should be appreciated that modifications and improvements can occur without departing from the scope of the following claims.

The invention claimed is:

1. A sawmill having:

an operator end;

a pair of end frames;

a track elevated by and extending from at least one end frame to the other;

a saw;

a carriage moveable to carry said saw along at least part of the track;

a swing arm coupled to said carriage;

a gas strut coupled to the swing arm;

a bolt coupled to the swing arm;

wherein the swing arm is configured to move around the bolt to free the gas strut to move the saw from a horizontal cutting orientation to a vertical cutting orientation; and a relocatable stopper associated with the track;

the sawmill formed such that the carriage is able to be driven away from the operator end on said track with the saw in the horizontal cutting orientation to contact the stopper when the carriage is at a predetermined position along the track, such contact resulting in the swing arm automatically moving the saw into the vertical cutting orientation for making a vertical cut back towards the operator end, the saw being such that when at the operator end, said saw can be manually flipped back to the horizontal cutting orientation.

2. A sawmill according to claim 1, wherein each end frame is generally in the shape of an inverted "T".

3. A sawmill according to claim 1, wherein each end frame is generally in the shape of an inverted "T" and there is only one track.

4. A sawmill according to claim 1, wherein each end frame is generally in the shape of an inverted "T", there is only one track and there is a controller at the operator end for activating movement of the saw carriage away from and subsequently back towards the operator end.

5. A sawmill according to claim 1, wherein each end frame is generally in the shape of an inverted "T", there is only one track, there is a controller at the operator end for activating movement of the saw carriage away from and subsequently back towards the operator end, and the swing arm releasably bears against a locking head to lock the saw in the horizontal cutting orientation.

6. A sawmill according to claim 1, wherein each end frame is generally in the shape of an inverted "T", there is only one track, there is a controller at the operator end for activating movement of the saw carriage away from and subsequently back towards the operator end, the swing arm releasably bears against a locking head to lock the saw in the horizontal cutting orientation, and wherein the swing arm releasably bears against a locking head to lock the saw in the vertical cutting orientation.

7. A sawmill according to claim 1, wherein the carriage has a rotating drum which engages a fixed cord or chain such that rotation of the drum causes the carriage the move along the cord or chain away from or towards the operator end depending on the direction that the drum rotates.

8. A sawmill according to claim 1, wherein the carriage has a rotating drum which engages a fixed cord or chain such that rotation of the drum causes the carriage the move along the cord or chain away from or towards the operator end depending on the direction that the drum rotates, and wherein the drum can be activated to turn clockwise or counterclockwise by pulling on a control cord from the operator end.

9. A sawmill according to claim 1, wherein the carriage has a rotating drum which engages a fixed cord or chain such that rotation of the drum causes the carriage the move along the cord or chain away from or towards the operator end depending on the direction that the drum rotates, wherein the drum can be activated to turn clockwise or anticlockwise by pulling on a control cord from the operator end, and wherein the control cord extends around a pivoting roller at the carriage and causes the roller to pivot up or down depending on how much tension the control cord is under, such pivoting movement of the roller causing movement of a lever connected to the pivoting roller to regulate the direction of movement of the carriage.

10. A sawmill according to claim 1, wherein the carriage has a rotating drum which engages a fixed cord or chain such that rotation of the drum causes the carriage the move along the cord or chain away from or towards the operator end depending on the direction that the drum rotates, wherein the drum can be activated to turn clockwise or anticlockwise by pulling on a control cord from the operator end, and wherein the control cord extends under fixed rollers situated either side of the pivoting roller.

11. A sawmill according to claim 1, formed such that manual movement of the saw from the vertical orientation to the horizontal orientation energizes the swing arm with sufficient energy to cause flipping of the saw from the horizontal to vertical orientation when the relocatable stopper is contacted by the carriage.

12. A sawmill having:

an operator end;

a pair of inverted "T" shaped end frames;

a single track elevated by and extending from at least one end frame to the other;

a saw;

a carriage moveable to carry a saw along at least part of the track;

a swing arm coupled to said carriage;

a gas strut coupled to the swing arm;

a bolt coupled to the swing arm;

wherein the swing arm is configured to move around the bolt to move the saw from a horizontal cutting orientation to a vertical cutting orientation; and a relocatable stopper associated with the track;

the sawmill formed so that the carriage is able to be driven away from the operator end along said single track with the saw in the horizontal cutting orientation to contact the stopper when the carriage is at a predetermined position along the track, such contact resulting in the freeing of the gas strut to automatically move the saw into the vertical cutting orientation for making a vertical cut back towards the operator end, the saw being such that when at the operator end it can be manually flipped back to the horizontal cutting orientation;

the carriage having a rotating drum which engages a fixed cord or chain such that rotation of the drum causes the carriage to move along the cord or chain away from or towards the operator end depending on the direction that the drum rotates, movement of the drum being controlled by pulling a control cord extending from the operator end, and the control cord extending around a pivoting roller at the carriage and causing such roller to pivot up or down depending on how much tension the control cord is under, such pivoting movement of the roller serving to regulate the direction of movement of the carriage.

13. A sawmill according to claim 12, formed such that manual movement of the saw from the vertical orientation to the horizontal orientation energises the swing arm with sufficient energy to cause flipping of the saw from the horizontal to vertical orientation when the relocatable stopper is contacted by the carriage.

* * * * *